US007389988B2

(12) United States Patent
Marbelt

(10) Patent No.: US 7,389,988 B2
(45) Date of Patent: Jun. 24, 2008

(54) DICE BOARD GAME

(76) Inventor: Fortunato Marbelt, P.O. Box 7091, Lowell, MA (US) 01852

( * ) Notice: Subject to any disclaimer, the term of this patent is extended or adjusted under 35 U.S.C. 154(b) by 130 days.

(21) Appl. No.: 11/374,019

(22) Filed: Mar. 14, 2006

(65) Prior Publication Data

US 2006/0208421 A1 Sep. 21, 2006

Related U.S. Application Data

(60) Provisional application No. 60/662,554, filed on Mar. 17, 2005.

(51) Int. Cl.
*A63F 3/00* (2006.01)

(52) U.S. Cl. ..... 273/243; 273/236

(58) Field of Classification Search ..... D21/341, D21/342, 334, 347, 348, 349; 273/236, 242, 273/243, 258, 287, 255, 262
See application file for complete search history.

(56) References Cited

U.S. PATENT DOCUMENTS

| | | | | |
|---|---|---|---|---|
| D197,566 | S | 2/1964 | Ward | |
| 3,829,098 | A | 8/1974 | Umminger, Jr. | |
| 4,042,245 | A | 8/1977 | Zarour | |
| 4,119,321 | A | 10/1978 | Creel | |
| 4,251,078 | A * | 2/1981 | Meirovitz | 273/265 |
| D274,440 | S * | 6/1984 | Zeldin | D21/366 |
| 4,541,633 | A * | 9/1985 | Newbill | 273/238 |
| 5,018,744 | A | 5/1991 | Patracuolia | |
| 5,156,406 | A | 10/1992 | Johnson et al. | |
| 5,171,018 | A * | 12/1992 | Zhang | 273/260 |
| 6,062,562 | A | 5/2000 | Pardee | |

FOREIGN PATENT DOCUMENTS

| | | |
|---|---|---|
| GB | 2204246 | 11/1988 |

* cited by examiner

*Primary Examiner*—Vishu K. Mendiratta
(74) *Attorney, Agent, or Firm*—Richard C. Litman

(57) ABSTRACT

The dice board game is played on a game board having two opposite peripheral sides defining rows of base positions. Each base position is an opponent's goal position. Each player designates the order and point value of his base positions before the start, with base position order and values and a "Game Over" designator being concealed from one another until the game is started. Each player controls a corresponding number of position markers, with dice determining which markers are advanced on each play. Either or both players may advance on any toss of the die, depending upon the outcome. Points are accrued as markers reach certain positions on the board. The winner acquires an agreed number of points by advancing markers across the board and taking points concealed beneath the opponent's base position markers along the opposite side of the board, or discovers the opponent's concealed "Game Over" designator.

19 Claims, 4 Drawing Sheets

DICE BOARD GAME

CROSS-REFERENCE TO RELATED APPLICATION

This application claims the benefit of U.S. Provisional Patent Application Ser. No. 60/662,554, filed Mar. 17, 2005.

BACKGROUND OF THE INVENTION

1. Field of the Invention

The present invention relates generally to board games. More specifically, the present game is played on a game board having two opposing rows of base positions, with the two players using specially configured dice to advance markers across the game board to the opposite base positions.

2. Description of the Related Art

Board games (chess, checkers, etc.) and games using chance means (dice, etc.) have been known for centuries. Other games using chance means to determine the outcome have also been known for a considerable time. As these games were developed and modified, the use of dice to govern the moves of playing pieces across or around a game board was applied to various games. Most such games utilize a single peripheral or other playing path about the board, with play involving perhaps several circuits about the board. Such board games utilizing a peripheral playing path and chance means to determine advancement often include simulated currency or the like as a means of determining the scoring and winner of the game. Each player controls only a single position marker, however.

Other games have been developed that provide multiple playing paths and multiple position markers across the game board (e.g., Chinese checkers), with still other games utilizing dice to determine the advance of multiple position markers in various combinations over the surface of the board (e.g., backgammon). While many players place wagers on the outcome of such games, there is no provision for the accumulation of points or simulated currency for scoring as the game progresses.

The present inventor is not aware of any board games using dice for advancement across the board, which include multiple interconnected playing paths from multiple starting positions toward multiple opposing goals. Moreover, none of the games of which the present inventor is aware allow the players to select the designation and/or value of their own starting positions, with the opposing players being required to adjust their paths across the board in order to arrive at the proper corresponding goal across the board. The present inventor also is unaware of any games using dice or the like to determine position marker movement in which the dice may randomly designate movement for the markers of both players with each toss of the dice by either of the players.

Thus, a dice board game solving the aforementioned problems is desired.

SUMMARY OF THE INVENTION

The dice board game comprises a game board having opposing base and starting positions for play by two players. Each side includes multiple base and starting positions, with each base position being given a different designation (number, etc.) and a different point value by each player before the start of the game. The designations are concealed from the opposing player until the game is started, with the values being concealed until the positions are reached by position markers during play.

Multiple interconnected playing paths extend across the board from each starting position on one side to each of the opponent's starting positions on the opposite side of the board. A series of intermediate positions or point value designators are provided at the intersections of the various playing paths, with these and other positions providing for the progressive accrual of points as the game progresses. Position markers are numbered or otherwise designated corresponding to the designations of the base positions, with specially configured dice being used to advance the correspondingly designated position markers one position at a time across the board. The dice include designators (numbers, etc.) corresponding to each set of position markers for each player, and may result in the advance of the markers of either or both players with each dice toss. Position markers may jump adjacent opposing markers, or may be used to provide protection for other markers upon reaching a protected area at the center of the board.

The object of the game is to accrue a predetermined point score by collecting points as position markers are advanced across the board and by collecting the previously determined point quantities concealed by the opposing player, upon reaching the opposite base positions of the board with the marker(s). One of the opposing base positions includes a concealed "Game Over" designator, which automatically wins the game (regardless of points accrued) for the player first encountering this position upon reaching the opponent's side of the board.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a dice board game in which the two players each have a plurality of individually designated base and starting positions, and in which the players move markers corresponding to those starting positions toward one another's base positions, with the opponents' base positions being the goal positions for each player. Each player conceals his or her base positions before the beginning of the game, and selects the order of the designated starting positions as desired.

Figure 1:
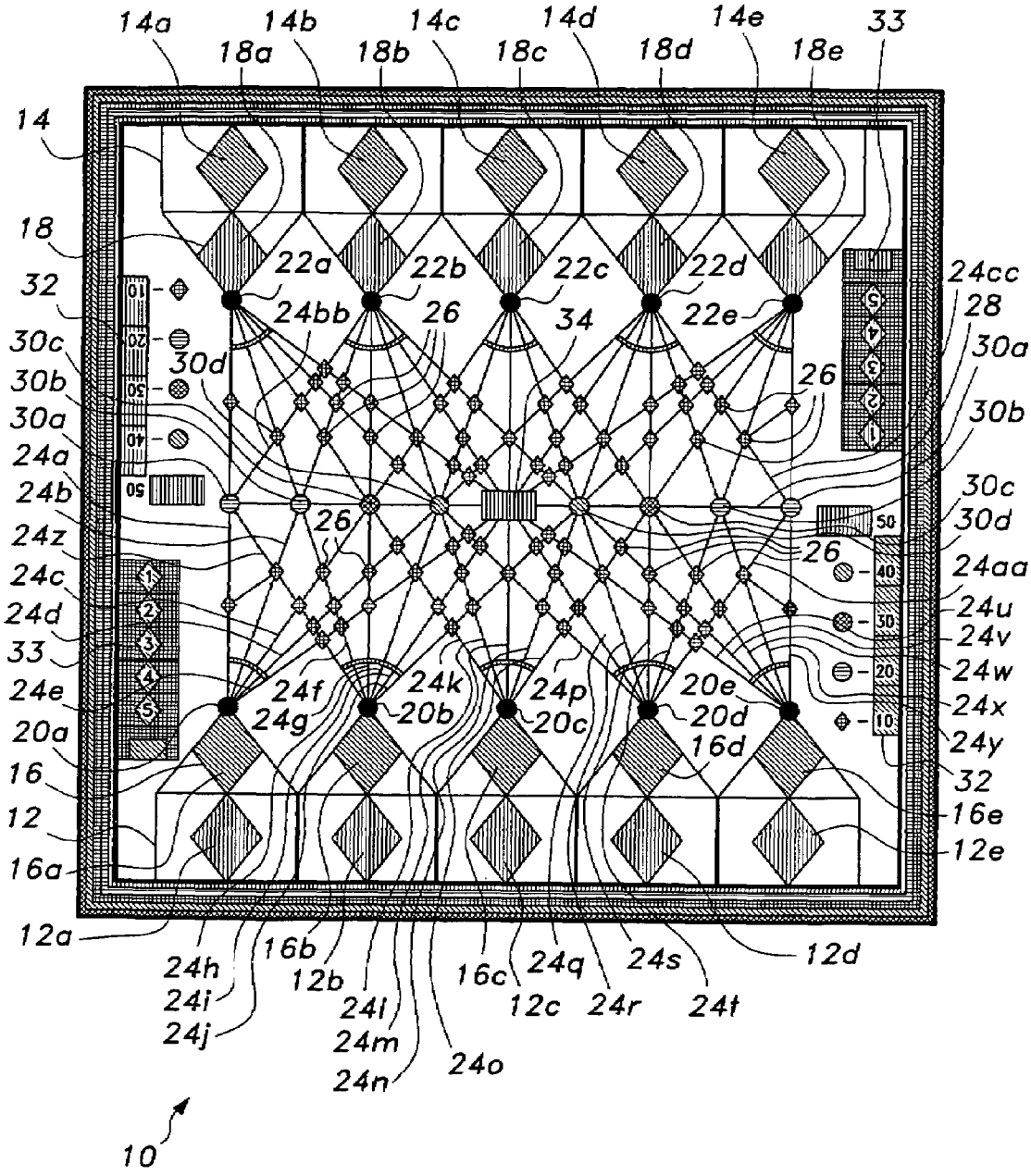
FIG. 1 is a top plan view of the game board of a dice board game according to the present invention.

FIG. 1 provides a plan view of the game board 10 for the present dice board game. The game board 10 includes two opposing base position grows 12 and 14, one for each of the two players. Each base position row 12 and 14 includes a series of individual base positions therealong, respectively positions 12*a* through 12*e* for the base position row 12 and positions 14*a* through 14*e* for the base position row 14. All base positions in any given row are preferably identically colored or otherwise designated, with the two rows having different colors from one another, e.g., red and green, etc.

A starting position row, respectively 16 for the first base position row 12 and 18 for the second base position row 14, is disposed adjacent the base position rows 12, 14 and toward the center of the board 10. Each starting position row 16 and 18 includes a plurality of starting positions corresponding in number to the base positions, i.e., starting positions 16*a* through 16*e* for the starting row 16, and 18*a* through 18*e* for the starting row 18. However, each starting row 16, 18 is colored opposite to its adjacent primary row, i.e., colored identically to the opponent's base row.

Each starting position terminates in an "exit point," i.e., a point from which the player position markers exit their starting positions to enter the center area of the board 10 during play. These exit points are designated as points 20*a* through 20*e* for the starting row 16, and 22*a* through 22*e* for the starting row 18.

Each exit point of each side of the game board is connected to each exit point of the opposite side of the board by a straight playing path extending directly therebetween. As there are five starting positions and exit points on each side of the board, this results in twenty-five playing paths extending directly between each exit point and every other exit point. These paths are designated as paths 24*a* through 24*y* in FIG. 1. In addition, a shorter path extends from the second and fourth exit points on each side to the outer end of a medial line, which extends across the board, with these four paths being designated as paths 24*z*, 24*aa*, 24*bb*, and 24*cc*. Additional paths connecting various path intersections on the board may be provided as desired.

Each path intersection is designated by a point value designator 26. The point value designators 26 provide players with points as the player position markers reach the designators 26 during the course of the game. In addition to the point value designators 26, additional point designators are disposed laterally along a medial line 28 across the board 10. The medial line point value designators 30*a* through 30*d* are disposed along the medial line 28, four such designators 30*a*-30*d* being symmetrically located on each side of a point bisecting medial line 28, with point value designations provided according to legends or indicators 32 disposed upon the game board 10. For example, the first and second outermost point designators 30*a* and 30*b* may be valued at twenty points, the next designators 30*c* at thirty points, and the inner designators 30*d* adjacent to the board center, at forty points. Other point values may be assigned to these designators 30*a* through 30*d*, as desired.

The center of the game board 10 includes a center of protection position 34, which also provides points (e.g., fifty points, as indicated by the legends 32) for the player whose position marker reaches the center position 34. The center of protection 34 also allows the player whose position marker reaches this point to designate another marker as being protected from being jumped by an opposing marker. This procedure is explained further below, in the discussion of the play of the game.

Figure 3:
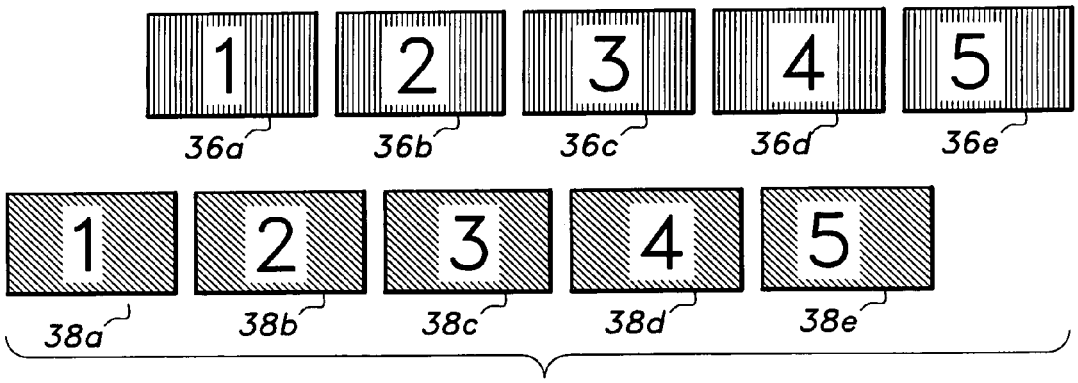
FIG. 3 is a top plan view of the base position markers for each player.

FIGS. 3 through 6B illustrate other components used in the present game. FIG. 3 is an illustration of all of the first and second base position designators, with five such designators 36*a* through 36*e* provided for one player and five designators 38*a* through 38*e* for the second player. These position designators 36*a* through 38*e* are placed atop the respective base positions 12*a* through 14*e* by each player to designate those positions relative to the position markers used in play, as explained further below.

Figure 4:
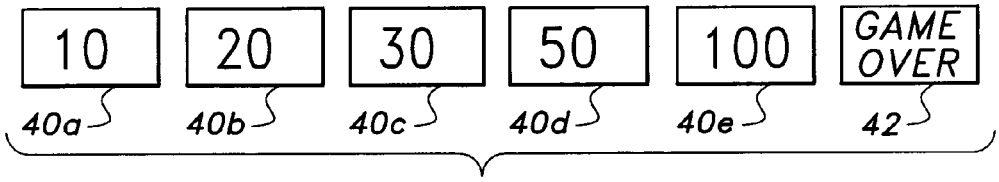
FIG. 4 is a top plan view of the different denominations of point quantity indicators used in the present game, along with a "Game Over" designator.

FIG. 4 provides an illustration of a series of point quantity indicators or simulated currency or money that may be used in the present game. A series of five different denominations, quantities, or values 40*a* through 40*e* may be provided, with other values or denominations being possible as desired. Some of these quantity indicators 40*a* through 40*e* are collected by players during the course of the game as their position markers reach the various point value designators on the board, described further above. Others are concealed beneath the position designators 36*a* through 38*e* by each player before the start of play of the game, and are collected by the opposing player who reaches that position on the game board during play. In addition to the quantity indicators 40*a* through 40*e* in FIG. 4, a pair of "Game Over" designators 42 is provided, one for each player. These "Game Over" designators 42 are concealed beneath one of the position designators 36*a* through 38*e* by each player along their respective side of the board before play begins.

Figure 5:
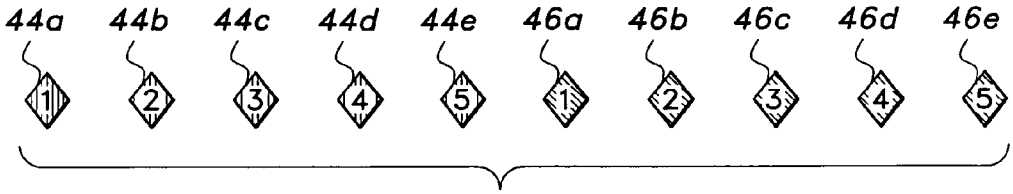
FIG. 5 is a top plan view of the two sets of position markers used in the play of the present game.

FIG. 5 provides an illustration of all of the position markers used in the present game. These markers comprise a series of five markers 44*a* through 44*e* for one player, and five markers 46*a* through 46*e* for the opposing player. The markers 44*a* through 46*e* are moved progressively across the board from their respective starting position rows 16 or 18, to the opponents' base position rows 12 or 14. The markers 44*a* through 46*e* are preferably colored (or otherwise differentiated) to correspond with their respective starting positions 16 or 18 and base position designators 36*a* through 38*e*, so players may readily recognize their own and their opponent's markers. The specific differentiation of each marker from one another, even in each player's set of markers, enters into the play of the game as described further below. The shape of the markers 44*a* through 46*e* is not critical, but preferably the markers relate to the shapes of the point value designators 26 at the intersections of the various playing paths on the board.

Figure 6A:
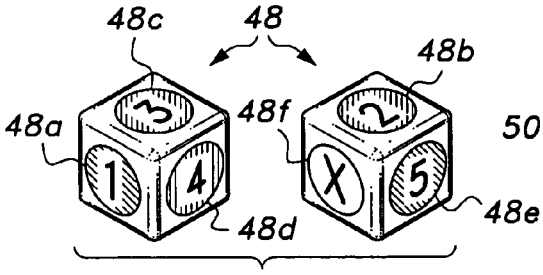
FIGS. 6A and 6B show all sides of the two cubical dice used in the present game.
Figure 6B:
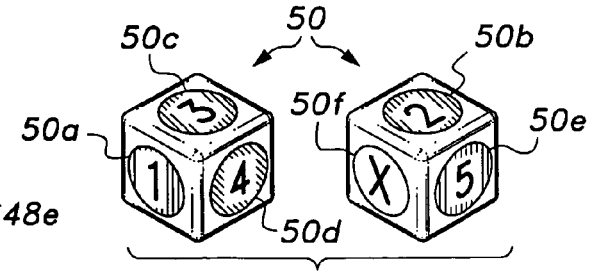

FIGS. 6A and 6B illustrate all of the faces of the two cubical dice 48 and 50 used in the play of the present game. Each of the dice includes six faces, respectively, 48*a* through 48*f* and 50*a* through 50*f*. However, the two dice are not identical, as each face is colored differently from its correspondingly numbered (or otherwise designated) counterpart on the other die. For example, the first faces 48*a* and 50*a* of the two dice 48 and 50 each contain the number "1," but the two faces are colored differently, with the first face 48*a* of the die 48 matching the color of the second set of player position markers 46*a* through 46*e* and the first face 50*a* of the die 50 matching the color of the first set of position markers 44*a* through 44*e*. This differentiation of the numerically identical faces of the two dice 48 and 50 continues throughout the five numbered faces 48*a* through 50*d*; other differentiation (e.g., alphabetic, symbolic, etc.) may be used as desired. The numbers and colors on each die face are used to designate the movement of the corresponding player position markers during play.

In addition to the five numerically distinct faces, each die 48 and 50 includes an additional symbol on the sixth face 48*f* and 50*f*. (An "X" is shown, but the symbol may be any letter, number, geometric shape, etc., as desired.) The symbols on the sixth faces 48*f* and 50*f* of the two dice indicate a second (or more) consecutive turn(s), when either or both turn up.

An interesting aspect of the present dice board game is the selective ordering of the first and second base row positions

Figure 2:
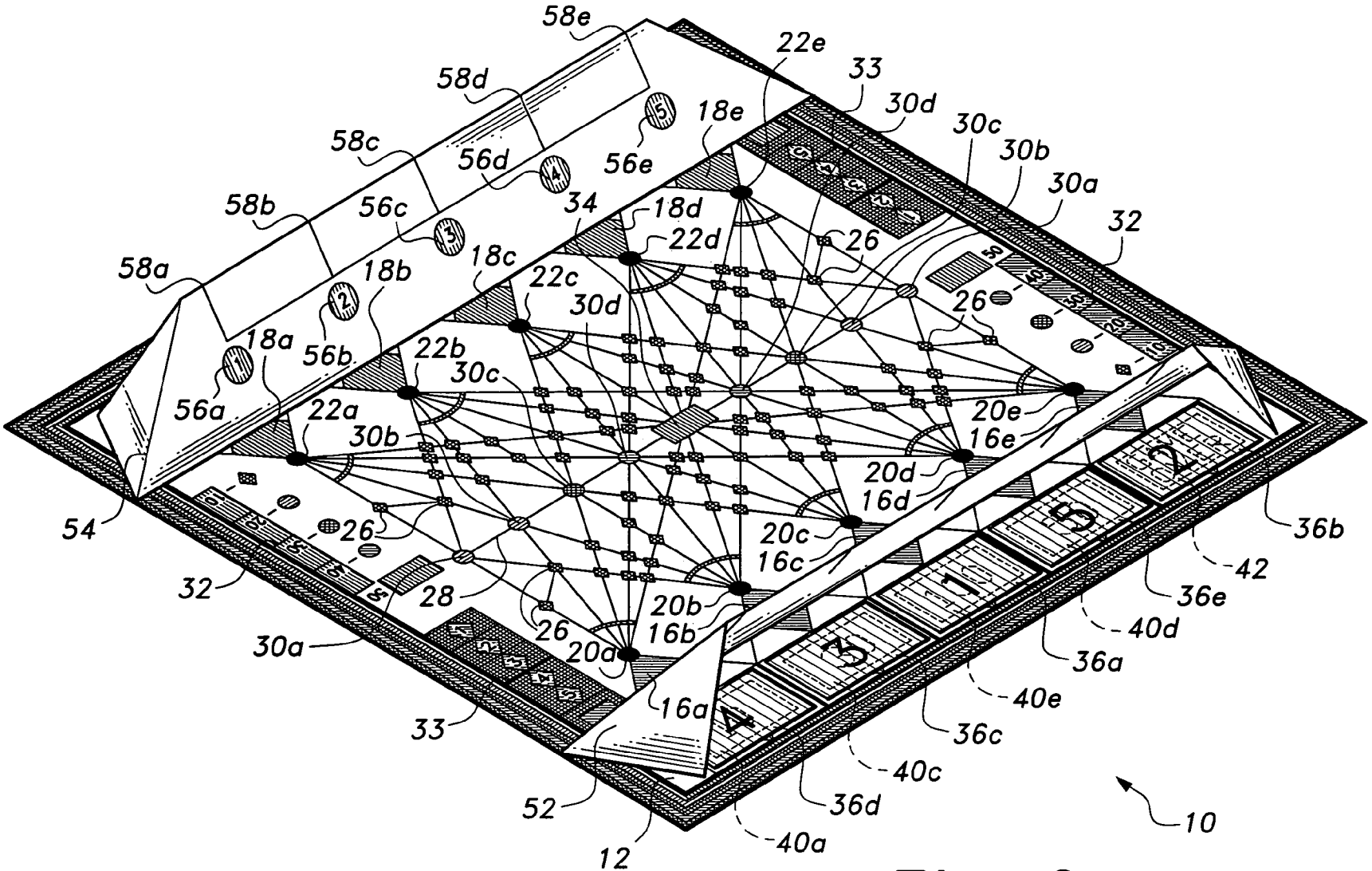
FIG. 2 is a perspective view of the game board of FIG. 1 with barriers in place to conceal the placement of position designators and values from each player before starting.

12*a* through 14*e* by each player before actual play begins. Players are free to place their respective base position designators 36*a* through 38*e* along their respective base positions 12*a* through 14*e* in any order they wish. As an example, it will be noted in the initial setup of the game, as shown in FIG. 2, the first player of the base positions 12*a* through 12*e* has set up his or her base position designators in the order 36*a*, 36*c*, 36*e*, 36*d*, and 36*b* i.e., 4, 3,1, 5, and 2. Players are free to choose any order they wish for the placement of their position designators along their respective base positions.

The base position designators function to indicate the starting positions and opposite goal positions for each of the correspondingly numbered or marked player position markers. However, they also serve to conceal the value of the point quantity indicators 40*a* through 40*e* placed thereunder, as well as the location of the "Game Over" designator 42 before the play of the game. The rules may be formulated to require any practicable maximum and minimum amount or point value to be concealed beneath each of the base position designators 36*a* through 38*e*, as desired. Preferably, some minimum value or amount is required to be placed beneath each of the designators along the base rows 12 and 14, and preferably some limit is placed upon the maximum value or amount which may be placed, along with some requirement for a total value or amount. These rules are due to the fact that the concealed points are collected by players when those players reach the corresponding base position(s) with their position marker(s) during play, and a predetermined value or amount must be collected in order to win the game, if the player does not encounter the "Game Over" designator 42 upon reaching the opponent's base position row.

As the exact denominations or values of the point quantity indicators 40*a* through 40*e*, the location of the "Game Over" designator 42 along each base row, and the specific positions of the base position designators 36*a* through 38*e* are to be concealed from opposing players before actual play begins, some means is required to conceal the placement of these components of the game from the opposing players. Accordingly, the present game includes first and second base row concealing panels, respectively 52 and 54, which are temporarily placed in front of the respective base rows 12 and 14 by the respective players prior to the start of the game. It will be noted that each of the concealing panels 52 and 54 includes a series of numbers thereon, e.g., 56*a* through 56*e* for the second panel 54 shown in FIG. 2, corresponding to the five positions along the corresponding base row, e.g., positions 14*a* through 14*e* shown along the second base row 14 on the game board 10 in FIG. 1. The numbers (other designators may be used) are placed in sequential order on the panels 52 and 54, as corresponding slots, e.g., 58*a* through 58*e* along the upper edge of the second panel 54, are used as place holders for collected point quantity indicators 40*a* through 40*e* during the course of play, as described further below.

Once the base row concealing panels 52 and 54 have been positioned, players place point quantity indicators 40*a* through 40*e* (in accordance with maximum and minimum amounts, per rules of the game) and a single "Game Over" designator 42 upon each of their five base positions, generally as shown along the first base row 12 of the game board 10 in FIG. 2, in hidden lines. Players then place their series of base position designators 36*a* through 38*e* upon their respective base positions 12*a* through 14*e*, atop the point quantity indicators or simulated currency 40*a* through 40*e* and "Game Over" designators 42 just placed upon those positions in order to conceal the specific amounts or denominations of the point quantity indicators 40*a* through 40*e* and the specific locations of the two "Game Over" designators 42 from one another.

At this point, the two base row concealing panels 52 and 54 are removed from their positions on the game board 10 and set aside for later use during play, as described further below, with the orders of the two sets of base position designators 36*a* through 38*e* being exposed to each player, as shown behind the first concealing panel 52 in FIG. 2. The position markers 44*a* through 46*d* are then placed upon their respective starting positions 16*a* through 18*e*, in the corresponding order determined by the placement of the base row position designators 36*a* through 38*b*. Thus, it will be seen that the initial positions of the position markers 44*a* through 46*d* will almost certainly not correspond with one another directly across the board 10, but will most likely appear to be randomized due to the selective placement of the base row position designators 36*a* through 38*b* by each player before the start of play. The order of play for the two players may be determined conventionally, e.g., tossing either or both of the two dice 48 and/or 50, with highest or lowest number playing first, or some other arrangement as agreed upon.

Figure 7:
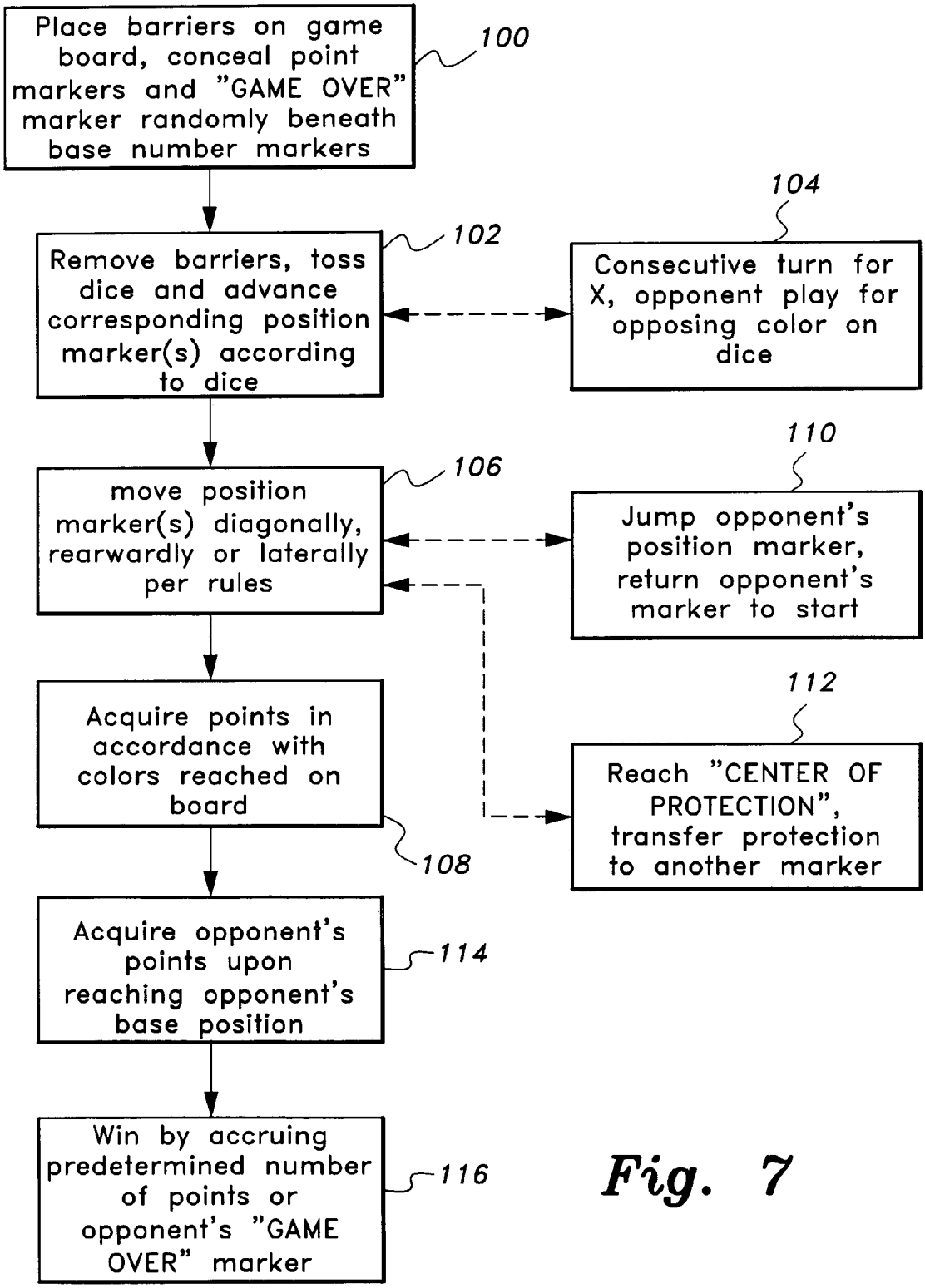
FIG. 7 is a flow chart describing the general steps in the method of play of the present game.

At this point, actual play of the game is ready to begin. FIG. 7 of the drawings provides a flow chart describing the basic elements in the method of play of the present game, beginning with the first step 100 of placing the base row concealing barriers 52 and 54 on the board 10 and concealing the point quantity indicators 40*a* through 40*e* and "Game Over" designator 42 beneath the base number markers or designators 36*a* through 38*e*, as described above.

After this first step 100 has been accomplished and the position markers placed along the starting positions and the order of play determined, the two players play by alternately tossing the two dice 48 and 50 to determine which of their position markers 44*a* through 46*e* will be moved. Each die 48 and 50 includes a series of five numbers (or other designators, as desired) thereon, and a sixth face having an "X" (or other designator) indicating a second (or more) consecutive turn(s) for the player. The numbered faces are of different colors (or other differentiating means) on the two dice, with each of the numbers one through five appearing once in each color on the two dice. Players move the correspondingly numbered position marker 44*a* through 46*e* a single position on each play according to the numbers and colors of the faces of the dice that turn up at each dice toss.

As an example of the above, let us assume that the two dice came up as indicated on the left side representation of the first die 48 of FIG. 6A, and the right side representation of the second die 50 of FIG. 6B. In this case, the first die 48 shows the red color shaded number "3" turned up, and the green shaded number "2" turned up. A player is only allowed to move his or her correspondingly colored and numbered position markers during play. Thus, if the player controlling the red markers 44*a* through 44*e* tossed the above combination, he or she would only be able to move his or her number 3 marker, i.e., the position marker 44*c* shown in FIG. 5. However, the opposing player is allowed to move any marker which matches the color and number which turn up on the dice, regardless of the player tossing the dice at any given turn. Thus, the opposing player, i.e., the player controlling the green colored position markers 46*a* through 46*e*, may move his or her green "2" marker 46*b* one position as a result of the above exemplary dice toss. The dice pass to the opposite player to toss for the next play when both colors turn up on a single dice toss.

If a player tosses two numbers having colors which match his or her position markers, then that player is allowed to move the two correspondingly numbered markers one position each. If a player tosses two numbers having colors which match the opponent's markers, then the opponent moves his or her two correspondingly numbered markers one position each. If a player comes up with an "X" (or other designator, as desired), then that player may move any marker one position as desired and receives a second consecutive toss of the dice, regardless of the number color turned up on the other die. If a player receives two "X" (or other consecutive turn indicator) on the dice, then that player may move two of his or her markers one position each as desired, and receives two consecutive turns with the dice. These various moves and rules are indicated generally by the second step 102 and optional third step 104 (depending upon whether or not a consecutive turn or opponent's color turns up on the dice) in FIG. 7.

Play continues generally as described above, with players attempting to move their position markers along the game board paths 24*a* through 24*cc* from the corresponding starting positions to the corresponding base positions of the opponent. Each marker is initially moved to the corresponding "exit point" 20*a* through 22*e* (depending upon which side of the board and corresponding markers are being played), and thence along the selected playing paths to advance toward the opponent's base positions.

In the initial example provided above where the dice 48 and 50 turn up a red "3" and a green "2," it will be noted that the red "3" base position designator 36*c* has actually been placed upon the second base position 12*b* in FIG. 2, according to the base position layout shown in FIG. 1. Accordingly, the red number "3" position marker would be advanced one position from the second starting row position 16*b*, directly in front of the red "3" base position designator 36*c*. Subsequent moves would advance that marker 44*c* whenever the die 48 turned up the red "3" face 48*c* on a dice toss, with the player advancing the marker 44*c* along the appropriate playing path toward the corresponding position of the base row 14 of the opposing player. If the opposing player placed his "3" base position designator 38*c* on the corresponding third base position 14*c*, then the most direct path for the red "3" marker 44*c* would be the path 24*h*, which extends directly between the second base position 16*b* of the first base position row 16, where the red "3" marker started, and the third base position 14*c* of the opposing second base row 14. As there is a playing path extending from each of the starting row positions 16 to each of the starting row positions 18, any position marker starting from any base position has a straight line path to its corresponding goal position as placed by the opposing player in the initial setup.

As the position markers are advanced across the board in accordance with the above-described procedure, they encounter point value designators 30 at each of the intersections of the various playing paths. Each time a position marker is advanced to one of the intersections with its point value designator 30, that player collects ten points. The appropriate point quantity indicator, i.e., indicator 40*a*, is placed in the corresponding slot of that player's base position concealing panel, which was set aside after the position and point value concealing procedure prior to the start of play. In the example of the red "3" marker 44*c* being advanced along the path 24*h*, the marker would initially reach the intersection point value designator 26 located at the intersection of the path 24*h* and paths 24*e* and 24*k*, gaining ten points when reaching that position. A corresponding denomination or value point quantity indicator 40*a* is then placed in the corresponding "3" position marker slot (not shown, but essentially the same as the slot 58*c* of the second concealing panel 54) of the first concealing panel 52, to indicate the accrued point total gathered by that position marker 44*c* as it advances across the board 10. The procedure is identical with other markers as they are moved in accordance with the numbers or designators that turn up on the dice 48 and 50 with each dice toss.

It will be noted that the most direct line between the exemplary second starting position 16*b* of the first starting row 16 and the goal position 14*c* of the opponent's base row 14 is directly along the path 24*h*, as noted further above. However, this path 24*h* contains only a single point value designator and intersection 26 between its starting position 16*b* and the medial line 28, with an additional four designators and intersections between the medal line and the opposite third starting position 18*c*. Other playing paths may contain additional intersections, and thus additional opportunities to gain points, e.g., the path 24*e*, which contains a total of ten intersections and point value designator positions 26 therealong.

Accordingly, the rules permit markers to be moved along other than direct paths between their starting and goal positions, so long as they remain along one of the playing paths. In the above example, the marker 44*c* may be moved from its first encountered at the intersection of the paths 24*h*, 24*e*, and 24*k*, diagonally to the right along the path 24*e*, if so desired. This results in the marker encountering two additional point value designators 26 along the path 24*e* than would be encountered along its more direct path 24*h* before reaching the medial line 28. The only restriction against such travel is that markers may not be moved back along the same path previously traveled in order to preclude the gathering of points more than once for a given position. A position marker advanced along such a composite path would thus receive more points than one traveling straight along the path 24*j*, due to its encounters with more intersections and point value designators. Such multiple or composite path movement is described generally in the fourth step 106 of the flow chart of FIG. 7.

However, this may or may not be a good strategy. While additional points are accrued in this manner, additional moves are also consumed without appreciably advancing the position marker toward the opposing goal. An opponent may take a more direct path and reach one of the first player's goal positions earlier, thus collecting points according to the point quantity indicators concealed beneath the corresponding base position designator. This may be sufficient for the opponent to win the game, depending upon (a) the number of points accrued by that player, (b) the number of points recovered by that player when he or she reaches the goal position, i.e., the base position of his or her opponent, or (c) whether the "Game Over" designator 42 was concealed beneath the base position designator reached. It will be seen that a number of factors can enter into the strategy of selecting a route along the playing paths to cross the game board to the opposite side and reach the opponent's base positions.

The medial line 28 includes a number of medial point value indicators 30*a* through 30*d*, to provide opportunities to accrue points in addition to the intersection point value indicators 26 described above. These medial point value indicators increase in value from the outermost positions 30*a* to the innermost positions 30*d*, with the "Center of Protection" position 34 between the two positions 30*d* providing an even higher point value if reached. The medial point value positions 30*a* through 30*d* increase in value from twenty points to forty points, with the "Center of Protection" position 34 being valued at fifty points when reached by a position marker. These values are indicated by the point value legends 32 to the near right corner of the board 10 for each player, opposite the position marker indicators 33 to the near left corner of the board 10 for each player.

A player accrues points according to the intermediate position indicator 30*a* through 30*d* reached and adds those points to the corresponding slot of his or her concealing panel 52 or 54, as appropriate. The same procedure is used to gather the fifty points provided by the "Center of Protection" position 34. Each of these positions may be color coded (or otherwise differentiated) to facilitate recognition of their values. This process or step is indicated generally by the fifth step 108 of FIG. 7. As in the case of movement over the general point value indicators 26 at the playing path intersections, position markers may not be moved back over one of the intermediate point value indicator positions 30*a* through 30*d*, if that marker has previously reached such a position or indicator. This is to prevent a marker from traveling back and forth repeatedly between two relatively high value positions and rapidly accruing a large number of points. However, a player may wish to adjust the path of his or her position marker(s) to travel laterally (inwardly or outwardly, as desired) once along the intermediate positions 30*a* through 30*d* (and the "Center of Protection" position 34) to accrue as many points as possible as the marker crosses the board 10.

In many instances, there will be situations where two opposing markers are traveling toward one another in opposing directions on the same path of travel as they work toward one another's opposite base positions. Accordingly, the present game includes a provision for jumping opposing position markers. When a marker is jumped, all points accrued to that point in the game by the jumped marker are transferred to the account of the jumping marker, with those points being added to the appropriate point quantity indicator slot of the concealing panel 52 or 54 held by the player playing the jumping marker. The jumped marker is moved back to its original starting position to begin play anew. This procedure is indicated generally by the optional sixth step 110 of FIG. 7.

As a countermeasure of protection against being jumped, a player may position one (and only one) of his or her position markers upon the "Center of Protection" position 34 in the center of the board 10 if that position may be reached in accordance with the rules of play described above, i.e., moving a marker designated by the dice 48 and 50 at one position per move from the starting position for that marker. From this position, a player may designate another marker as being protected from being jumped.

As an example of the above, a first player may have reached the "Center of Protection" position 34 with one of his or her markers. Another of his or her markers may be resting upon the intersection 26 defined by playing paths 24*h*, 2424*e*, and 24*k*, while an opponent's marker is resting upon the adjacent intersection 26 of paths 24*d* and 24*k*, traveling toward the first base position 12*c* along the path 24*k*. If the first marker is not protected, it may be jumped and returned to its starting position, with all points accrued by that marker being transferred to the jumping marker of the opponent. This is particularly harmful if the marker being jumped has reached a point close to the opposing player's starting line, where all the progress made to that point and the appreciable number of points gathered by that marker will be lost.

Accordingly, the player having a marker on the "Center of Protection" position may designate his or her marker that is in danger of being jumped as immune to such a jump. Once the other marker has been protected, the marker resting upon the "Center of Protection" position 34 must be moved, as no further protection is allowed. The marker previously on the "Center of Protection" position 34 may be moved laterally or rearwardly by one position, with no additional accrual of points permitted. Thus, no additional advantage is provided to a marker leaving the "Center of Protection" position 34. This process or step is described generally in the optional seventh step 112 of FIG. 7.

Play continues in accordance with the above-described rules of play with markers eventually reaching the opponent's base position row, either the second player's row 14 comprising positions 14*a* through 14*e* for the first player's position markers 44*a* through 44*e*, or the first player's base position row 12 comprising positions 12*a* through 12*e* for the second player's markers 46*a* through 46*e*. When the opposing player's appropriate base row position is reached, the corresponding base position designator 36*a* through 38*e*, placed upon the base positions immediately before the start of the game, is removed to reveal the point quantity indicators 40*a* through 40*e* which had been placed thereunder by the opposing player before the game start. These points are awarded to the position marker having reached this opponent's base position, and placed in the appropriate slot of the successful player's base row concealing panel 52 or 54, as appropriate. The position marker that reached the opponent's appropriate base row position is returned to its original starting position to begin its traverse of the board 10 anew and acquire more points. This process is indicated generally in the eighth step 114 of FIG. 7.

The game continues generally as described above until one of the players reaches a predetermined number of points, e.g., one thousand, although this may be adjusted as desired. Generally, a marker will average on the order of about 300 points (more or less) in its travel across the board, depending upon the number of point value designator intersections reached, the number of medial line point value indicators or designators reached, whether the "Center of Protection" position was reached, and the amount or value of the point quantity indicators concealed beneath the base position indicator reached. In many instances, points will be accrued when an opponent's marker is jumped, which, of course, lowers the cumulative point count for the player whose marker was jumped. In any event, it generally requires that at least a few of the markers reach the opponent's base row positions, in order for a player to acquire sufficient points to win the game.

However, it will be recalled that another means of ending the game was provided in the initial setup procedure, when the various denominations of point quantity indicators 40*a* through 40*e* were concealed by each player. At that time, each player placed a "Game Over" designator or indicator 42, on one of his or her base positions 12*a* through 14*e*, and concealed it (along with the point quantity indicators 40*a* through 40*e* placed on the other four base positions) beneath the base position indicators 36*a* through 38*e*. In the event that a player's position marker reaches the opponent's position having the "Game Over" indicator 42 beneath the concealing base position indicator, the game is ended once the base position indicator is removed to reveal the "Game Over" indicator 42. The player whose marker reached the "Game Over" indicator is the winner of the game. This step, along with the provision for winning by accruing a predetermined number of total points, is indicated generally by the final or ninth step 116 of the flow chart of FIG. 7.

In conclusion, the present dice board game provides a number of differing opportunities and strategies for play, along with two different possibilities for a player to win the game. The concealment of each player's starting positions and their values before the start of the game, results in an element of the unknown for the goal by each player until the game is well underway and at least some of the goal positions have been reached and their values revealed. Moreover, the provision of a "Game Over" indicator, which results in the sudden ending of the game by a player who reaches that previously concealed position, results in an element of suspense when a player is close to reaching any of his or her opponent's base positions, as their values (and chance of an immediate win) are unknown. In addition, the play along and across the playing paths of the board requires a certain amount of strategy by the players involved, in consideration of possible point accrual and setback of opposing markers and capturing of their accrued points. Thus, while the present game is based upon chance elements, players have a reasonable amount of control over the play of the game in its intermediate play. The result is a game that is quite fast-paced, but will hold the interest of players for a considerable time.

It is to be understood that the present invention is not limited to the embodiment described above, but encompasses any and all embodiments within the scope of the following claims.

I claim:

1. A method of playing a dice board game, comprising the steps of:

providing a game board having:

a first base position row;

a second base position row opposite the first base position row;

a plurality of base positions disposed along each of the base position rows;

a first starting position row adjacent the first base position row;

a second starting position row adjacent the second base position row;

a plurality of starting positions disposed along each of the starting position rows;

a plurality of straight playing paths interconnecting each of the starting positions of the first starting position row directly with each of the starting positions of the second starting position row;

a plurality of first base position designators;

a plurality of second base position designators;

a plurality of first position markers corresponding to the first base position designators;

a plurality of second position markers corresponding to the second base position designators;

a plurality of quantity indicators in assorted denominations; and a first die and a second die;

concealing opposing base positions along opposite sides of the game board from an opposing player;

each player placing point quantity indicators along the player's set of the base positions;

each of the players placing a "Game Over" designator upon one of the player's base positions;

each of the players placing base position designators atop the point quantity indicators and the "Game Over" designators for the player's base positions, thereby concealing the point quantity indicators and "Game Over" designators;

revealing the arrangement of the base position designators to each of the players;

advancing correspondingly designated position markers across the game board;

accruing points according to position marker advancement and attainment of the corresponding opposing base position of the game board; and winning the game upon first accruing an agreed number of points or first reaching the opponent's Game Over" designator, whichever occurs earlier.

2. The method of playing a dice board game according to claim 1, further including the steps of:

(a) tossing the dice and advancing position markers corresponding to the designators on the dice by one position each;

(b) selecting playing paths according to the opposing base positions correxponding to the position markers being moved;

(c) accruing points according to the advance of the position markers across the board; and (d) accruing points upon reaching the correspondingly designated opponent's base positions with the position markers according to the point quantity indicators previously placed at those positions.

3. The method of playing a dice board game according to claim 1, further including the step of advancing position markers of each player according to first and second player marker designators on the dice, regardless of player turn.

4. The method of playing a dice board game according to claim 1, further including the step of taking at least one additional consecutive turn according to at least one additional turn designator on the dice.

5. The method of playing a dice board game according to claim 1, further including the steps of:

(a) moving at least one position marker laterally along a medial line of the game board; and (b) accruing additional points according to point designators disposed along the medial line.

6. The method of playing a dice board game according to claim 1, further including the steps of:

(a) jumping an opponent's adjacent position marker;

(b) returning the jumped position marker to its original starting position; and (c) transferring points accrued by the jumped position marker to the player holding the jumping marker.

7. The method of playing a dice board game according to claim 1, further including the steps of:

(a) reaching the center of protection at the center of the game board with one of the position markers; and (b) designating another position marker as protected from a jump by an opponent's position marker due to positioning of one of the position markers on the center of protection.

8. A method of playing a dice board game, comprising the steps of:

providing a game board having:

a first base position row;

a second base position row opposite the first base position row;

a plurality of base positions disposed along each of the base position rows;

a first starting position row adjacent the first base position row;

a second starting position row adjacent the second base position row;

a plurality of starting positions disposed along each of the starting position rows;

a plurality of straight playing paths interconnecting each of the starting positions of the first starting position row directly with each of the starting positions of the second starting position row;

a plurality of first base position designators;

a plurality of second base position designators;

a plurality of first position markers corresponding to the first base position designators;

a plurality of second position markers corresponding to the second base position designators;

a plurality of quantity indicators in assorted denominations; and a first die and a second die;

placing a plurality of point values and a "Game Over" position along a corresponding plurality of base positions on opposite edges of the game board;

placing base position designators on the base positions of the game board;

concealing the opposing base positions along opposite sides of the game board from the opposing player;

tossing the dice and advancing position markers corresponding to the designators on the dice by one position each;

selecting playing paths according to the opposing base positions corresponding to the position markers being moved;

accruing points according to advance of the position markers across the board;

accruing points upon reaching correspondingly designated opponent's base positions with the position markers according to the point quantity indicators previously placed at those positions; and winning the game upon first accruing a predetermined number of points and first reaching the opponent's "Game Over" designator, whichever occurs first.

9. The method of playing a dice board game according to claim 8, further including the steps of:

(a) placing base position designators atop the point value and "Game Over" designators as desired by each player, thereby concealing the point quantity indicators and "Game Over" designators; and (b) revealing the arrangement of the base position designators to each player.

10. The method of playing a dice board game according to claim 8, further including the step of advancing position markers of each player according to first and second player marker designators on the dice, regardless of player turn.

11. The method of playing a dice board game according to claim 8, further including the step of taking at least one additional consecutive turn according to at least one additional turn designator on the dice.

12. The method of playing a dice board game according to claim 8, further including the steps of:

(a) moving at least one position marker laterally along a medial line of the game board; and (b) accruing additional points according to point designators disposed along the medial line.

13. The method of playing a dice board game according to claim 8, further including the steps of:

(a) jumping an opponent's adjacent position marker;

(b) returning the jumped position marker to its original starting position along the base positions; and (c) transferring points accrued by the jumped position marker to the player holding the jumping marker.

14. The method of playing a dice board game according to claim 8, further including the steps of:

(a) reaching the center of protection at the center of the game board with one of the position markers; and (b) designating another position marker as protected from a jump by an opponent's position marker due to the positioning of one of the position markers on the center of protection.

15. A dice board game, comprising:

a game board, having;

a first base position row;

a second base position row opposite the first base position row;

a plurality of base positions disposed along each of the base position rows;

a first starting position row adjacent the first base position row;

a second starting position row adjacent the second base position row;

a plurality of starting positions disposed along each of the starting position rows;

a plurality of straight playing paths interconnecting each of the starting positions of the first starting position row directly with each of the starting positions of the second starting position row;

a plurality of first base position designators;

a plurality of second base position designators;

a plurality of first position markers corresponding to the first base position designators;

a plurality of second position markers corresponding to the second base position designators;

a plurality of point quantity indicators in assorted denominations; a first and second base position row concealing panel corresponding to each said base position row; and a first die and a second die.

16. The dice board game according to claim 15, further including a first and a second game over designator corresponding to each said base position row.

17. The dice board game according to claim 15, wherein said first die and said second die each include a plurality of designators thereon corresponding to said first and said second position markers and a second consecutive turn designator.

18. The dice board game according to claim 15, wherein:

said plurality of playing paths of said game board define a plurality of intersections; and a point value designator is disposed at each of said playing path intersections.

19. The dice board game according to claim 15, further including:

a medial line disposed across said game board;

a plurality of point value designators having a plurality of values, the designators being disposed along the medial line; and a center of protection position disposed centrally upon the medial line.

* * * * *